United States Patent [19]

Radek

[11] 4,093,078

[45] June 6, 1978

[54] TANDEM MERCHANDISE DISPLAY EQUIPMENT

[75] Inventor: John R. Radek, Hinsdale, Ill.

[73] Assignee: Ready Metal Manufacturing Company, Chicago, Ill.

[21] Appl. No.: 701,071

[22] Filed: Jul. 15, 1976

[51] Int. Cl.[2] ..... A47F 5/10

[52] U.S. Cl. ..... 211/189; 211/182

[58] Field of Search ..... 211/189, 190, 191, 187, 211/192, 183, 182, 134; 108/108, 109; 312/257 SK, 257 R, 108; 52/646, 645, 648

[56] References Cited

U.S. PATENT DOCUMENTS

| | | | |
|---|---|---|---|
| 3,229,824 | 1/1966 | De'Caccia | 211/187 X |
| 3,297,374 | 1/1967 | Radek | 108/108 X |
| 3,329,282 | 7/1967 | Swan et al. | 211/190 |
| 3,391,795 | 7/1968 | Finlayson | 211/134 |
| 3,606,024 | 9/1971 | Mieville | 211/187 X |
| 3,827,377 | 8/1974 | Aughtry | 108/108 |

FOREIGN PATENT DOCUMENTS

| | | | |
|---|---|---|---|
| 372,442 | 11/1963 | Switzerland | 108/108 |

*Primary Examiner*—Ramon S. Britts
*Attorney, Agent, or Firm*—Frank H. Marks

[57] ABSTRACT

Equipment for housing and displaying, in a retail establishment, merchandise disposed on tables, drawers, cabinets, shelving, etc. The present invention represents an improvement over that disclosed and claimed in my U.S. Pat. No. 3,297,374, dated Jan. 10, 1967, and is particularly concerned with a skeletal tandem frame, i.e., a construction characterized in display units extending in opposed relation to a central support. I have solved certain problems previously encountered in this type of equipment by making certain basic changes in the structural elements of the frame structure. In general, my invention contemplates the use of channel members in lieu of tubing, along with other changes. My invention is also applicable to wall disposed equipment as well as tandem.

5 Claims, 9 Drawing Figures

10
12
15
16
18
20
25
30
32
40
40'
80
82
85
85'
87
P
G
L 12
12'
16
20
20a
20b
25
15
35
36
50
52
52'
53
55
58
65
68
70
72
S
C
W

TANDEM MERCHANDISE DISPLAY EQUIPMENT

My invention marks an improvement in that covered by my U.S. Pat. No. 3,297,374, issued Jan. 10, 1967, relating to merchandise storage and display equipment specially adapted for use in retail stores.

Said equipment, in general, consists of skeletal framework supporting merchandise housing and display elements such as drawers, tables, shelving and the like. The equipment is specially designed for knockdown construction, whereby it may conveniently be shipped, stored and quickly and easily erected and demounted. My improvement pertains to the framing.

BACKGROUND

My earlier patent above referred to along with the prior art cited therein best illustrate the state of the art prior to the present invention.

BRIEF OUTLINE OF THE INVENTION

My patented equipment, which has been highly successful commercially, has usually employed square tubing in its framing. In certain important markets serious difficulties have been encountered in the procurement of such material.

In order to meet market requirements, it has accordingly been found necessary to redesign the framing structure.

A major objective of my research has been development of a frame embodying struts and beams with associated tie means as required to support the heavy loads encountered in such equipment while avoiding the use of tubing.

In the solution of my problem, serious consideration had to be given to such matters as cost of materials and their fabrication and engineering feasibility, while retaining all advantages of the former design, to achieve a commercially acceptable product.

After considerable study I have devised a skeletal frame of the character referred to employing vertical and horizontal channel elements, with required tie members, to provide a knockdown structure meeting requirements of the trade, with no sacrifice of strength of other advantages of my patented equipment.

In order best to achieve the above outlined objectives, I have found it necessary to devise original procedures which make possible economies needed to meet competitive conditions of the market place.

Various other objects and advantages will become apparent to those skilled in the art as the description proceeds.

BRIEF DESCRIPTION OF THE DRAWINGS

Turning now to the drawings illustrating a preferred embodiment of my invention.

DETAILED DESCRIPTION

Let it be clearly understood that, while my invention is described with particular reference to a tandem frame, characterized by positioning away from a wall for access from either side, the invention is likewise applicable to wall-positioned equipment accessible from only one side.

Figures 1, 2, 3, 4:
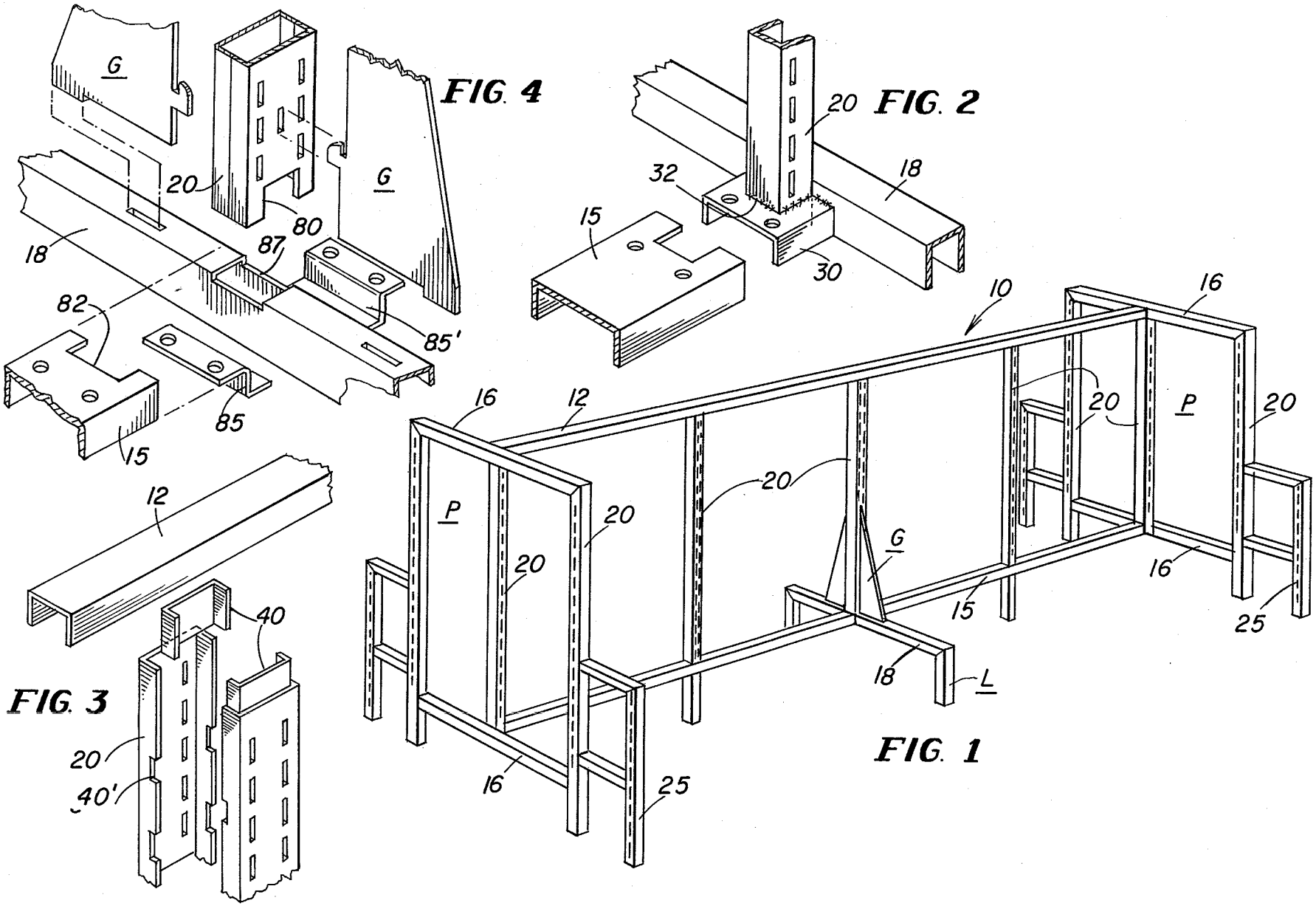
FIG. 1 is a perspective view of a skeletal frame for supporting merchandise housing and display equipment, exemplary of my invention.
FIG. 2 is a fragmentary exploded perspective on an enlarged scale showing a preferred arrangement for joining a vertical end element of the frame to longitudinal and transverse base elements.
FIG. 3 is a similar view showing the juncture of a center vertical element to a longitudinal top element.
FIG. 4 is a similar view showing assembly of a center upright element with longitudinal and transverse bottom members.

In FIG. 1, numeral 10 indicates generally one arrangement of a tandem frame designed to support a wide variety of merchandise housing, supporting and display equipment, as set forth in considerable detail in my patent hereinabove referred to.

Said frame comprises a top horizontal beam member 12 and a bottom horizontal beam member 15, both of said members being here considered as units.

To maintain the frame in erect position, I provide upper and lower transverse end beams 16, 16 and one or more transverse intermediate beams 18 with depending legs L.

Connecting the horizontal members are strut members or uprights 20. Thus, the ends of the frame constitute rectangular hollow panels P within which, if desired, may be mounted display boards or the like.

Projecting outwardly from said end panels are F-shaped outriggers 25 serving as auxiliary supports for drawers bins, etc.

Reference to my patent will suggest a variety of merchandise storage and display equipment that may be mounted on opposite sides of the frame shown in FIG. 1, or on one side only if wall mounted, and also extending laterally from end panels P.

ASSEMBLY OF PARTS

Referring first to FIG. 2, a vertical end strut or upright 20, formed as a channel, is secured to a bottom transverse beam 18 as by welding, with the open side of said member 20 facing laterally. The horizontal members are likewise channels.

An intermediate attaching bracket 30 of channel form with a rectangular notch as at 32 is secured to the lower end of strut 20 as by welding.

Lower beam 15 is detachably secured to bracket 30 by providing a rectangular notch in the end thereof corresponding to notch 32 in bracket 30 and bringing the beam into overlying position in juxtaposition to the bracket and providing registering tapped holes in the bracket and beam. Attachment may be made by employing, for example, Allen screws and weldnuts in a manner well known to those skilled in the art.

A flange of upright 20 may be notched, as seen in FIG. 2, to seat a reinforcing gusset plate G (FIG. 1), the latter being provided with bayonet hooks for the purpose.

It may be noted that the construction of FIG. 2 may be employed for attachment of an "add-on" longitudinal extension of the frame, to make the latter of any desired length.

Figures 5, 6, 7, 8, 9:
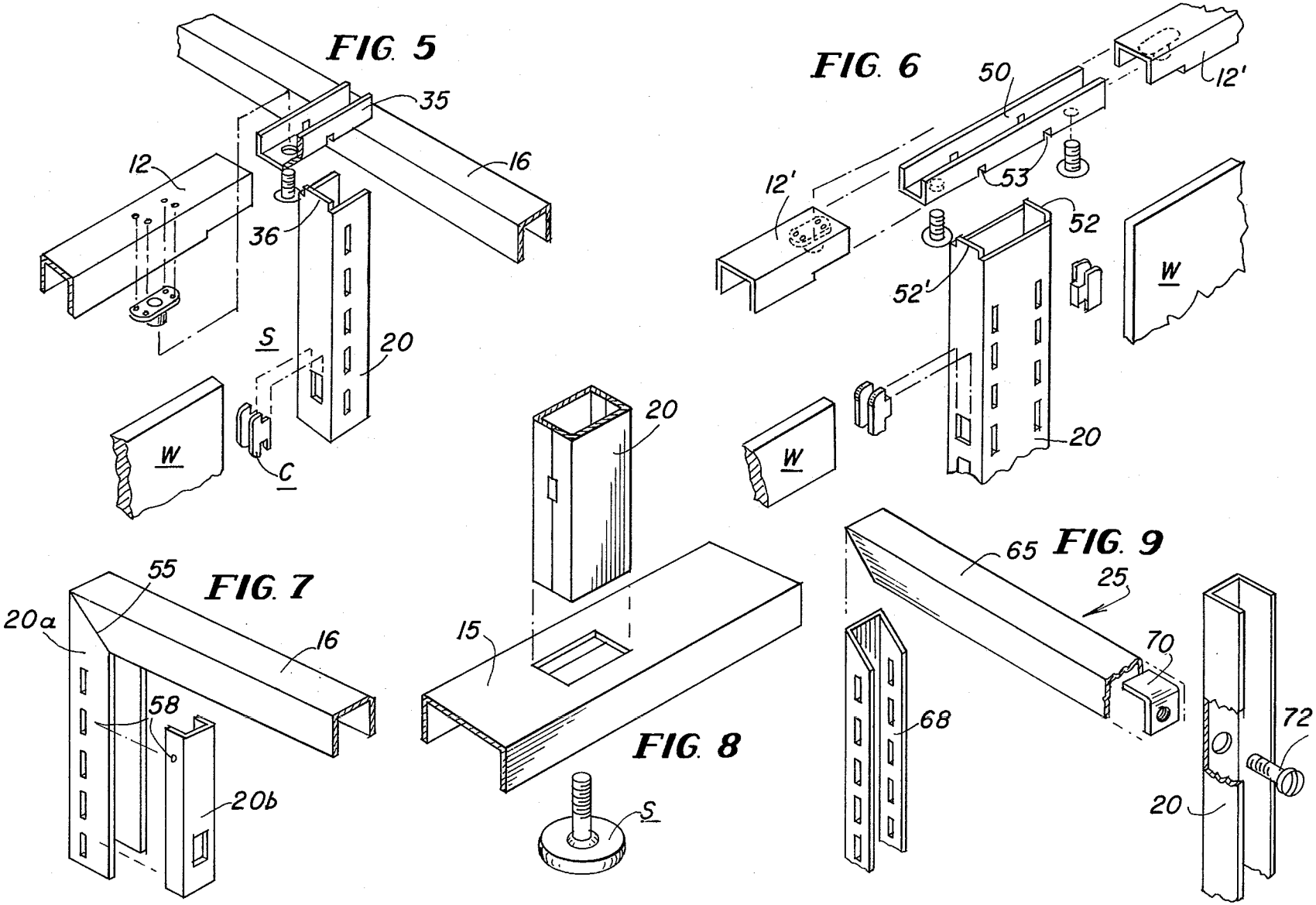
FIG. 5 is a similar view illustrating assembly of an end upright with top longitudinal and transverse members.
FIG. 6 is a similar view showing assembly of a center upright with top longitudinal members.
FIG. 7 is a similar view showing a top corner portion of the frame.
FIG. 8 is a similar view showing assembly of a center frame upright with a bottom longitudinal element.
FIG. 9 is a similar view showing assembly of an outrigger with an end upright.

As seen in FIG. 5, end strut 20 may be secured to top horizontal members, i.e., longitudinal beam 12 and transverse beam 16, as follows. The strut may be welded to beam 16. A channel shaped bracket 35 is welded to beam 16, said bracket being cut out to receive a tongue 36 on the end of strut 20, the latter being welded therein. Beam 12 may be cut out at the end to straddle the bracket and make a smooth juncture. As in the bottom construction (FIG. 2), detachable connection may be made by use of a weldnut and screw.

Slots may be provided in a side (flange) portion of the post to facilitate attachment of a wallboard W through an auxiliary clip C.

As seen in FIG. 3, a center upright 20 may be formed by securing together a pair of channel members, as by plug-welding at spaced poins 40', said channels being provided with the usual vertically spaced attachment slots.

The post may be secured to top longitudinal channel beam 12 to provide a neat, clean juncture (FIG. 1) by means of intermediary channel brace members 40, 40 mig-welded to the beam and post, respectively.

Center post 20 may be attached to bottom longitudinal channel beam 15 (FIG. 8) by mig-welding the post to the beam.

A threaded plug (not shown) may be inserted in the end of post 20 to receive a leveling screw S.

As seen in FIG. 6, an intermediate or center post 20 formed by plug-welding a pair of channels (see FIG. 3) may be detachably secured to top longitudinal beam 12 by a channel mounting bracket 50. The upright is formed to provide tongues 52, 52 welded into seats 53, 53 formed in bracket 50. Longitudinal beam sections 12', 12' are detachably connected to the bracket (see FIG. 5) and similar provision may be made for mounting panels W if desired.

FIG. 7 details an upper corner construction of an end frame. Top end frame channel 16 and an end upright 20*a* may be mig-welded as at diagonal joint 55.

A stiffener channel 20*b* of reduced width compared to member 20*a* is nested in channel 20*a*, secured by spot-welding at spaced points along their juxtaposed legs as at 58. Slots and clips (FIG. 5) may be provided for mounting a panel W.

FIG. 9 shows attachment to an end frame upright 20 of an outrigger 25 (FIG. 1). Top channel member 65 of the outrigger is mig-welded to upright channel member 68 and is detachably connected to upright 20. For this purpose an angular mounting bracket may be spot-welded into the end of channel 65 and perforated to permit passage of screw 72, which may be secured by a nut (not shown).

As seen in FIG. 4, a center upright 20 may be attached to a bottom longitudinal beam and a transverse bar 18 as follows. The upright is preferably formed of a pair of channels secured together as in FIGS. 3 and 4, while the horizontal members 15 and 18 may be simple channels.

The upright may be permanently fixed to transverse bar 18 as by mig-welding, being cut out as at 80 to permit straddling bar 18 to which it is welded. Beam 15 is likewise cut out as at 82 to permit its straddling upright 20.

A generally Z-shaped mounting bracket 85 is secured as by welding to the bottom of bar 18 and is perforated to permit detachable securement of beam 15 as by screws passing through holes provided in said beam and through a cutout 87 in the web portion of beam 18. A similar mounting bar 85' provides for detachably mounting another longitudinal beam on the opposite side of transverse bar 18 and in continuation of beam 15 seen in FIG. 4 (see FIG. 1).

CHANNEL BAR FABRICATION

A certain sequence of steps has been found most expeditious in fabrication of the channel shaped structural members utilized in my invention. Starting with strip steel of the desired gage and width, the strip is first notched to provide the desired recesses described above. The notched strip is then punched to provide the needed holes, then bent to channel form and finally cut to the desired lengths.

SUMMARY AND CONCLUSION

As shown hereabove, my improved frame construction completely avoids the use of tubular elements, relying exclusively on channel members. I have found such members entirely satisfactory to meet my structural requirements, with attendant advantages as outlined in part hereabove.

In such parts of the assembly, particularly in upright members, where stresses may be expected to exceed the limitations of channels alone, it is noted that reinforcement may be provided by joining a pair of parallel channels, either secured edge-to-edge with abutting flanges welded together at spaced points, as in FIGS. 3, 4 and 8, or by nesting them as in FIG. 7.

I have not specified particular dimensions or gage of materials inasmuch as such details are considered matters of judgment within the knowledge of those skilled in the art.

Various changes coming within the spirit of my invention may suggest themselves to those skilled in the art. Hence, I do not wish to be limited to the specific forms shown or uses mentioned, except to the extent indicated by the appended claims.

I claim:

1. A knockdown frame for supporting merchandise display and housing equipment, comprising (a) a pair of laterally spaced transverse beams of channel cross-section on the same level adjacent the lower end of the frame, with the flanges of said channels extending downwardly, (b) a vertical strut of channel form affixed to the downwardly facing flanges of each of said beams with the flanges of the channel of said strut extending outwardly, (c) a second pair of laterally transverse beams of channel cross-section on the same level at the upper end of the frame and overlying said first pair of transverse beams, the flanges of the second pair of channels extending downwardly, (d) means for joining the upper end of said vertical strut to the downwardly facing flanges of said second pair of beams, (e) a channeled lug welded to the lower end of each strut and projecting in a longitudinal direction from each of said first-mentioned downwardly facing flanges, with the web of the lug uppermost and its inner portion having a rectangular recess adapted to embrace said strut, and the inner edges of said web welded to the respective flanges of said first-mentioned transverse beams, and (f) a longitudinal beam of channel cross-section with the flanges extending downwardly between said channeled lugs and with the ends thereof disposed in superposed relation to said lugs and having a rectangular recess in the outer ends for embracing each vertical strut as well as openings in proximity thereto in alignment with corresponding openings in the webs of the lugs for receiving detachable interconnecting fastening means therebetween.

2. A knockdown frame as in claim 1, including an upper longitudinal beam extending between said second pair of transverse beams.

3. A knockdown frame as set forth in claim 2, including channel structural members for detachably connecting said last-mentioned upper longitudinal beam to said second pair of transverse beams, comprising (a) a second channeled lug with the web thereof welded to the top of said upper beam and projecting inwardly therefrom, (b) means for interconnecting each of said last-mentioned lugs with the adjacent transverse beam and vertical strut, and (c) cooperating fastening means adjacent to the ends of said upper longitudinal beam and said projecting portions of said last-mentioned lugs.

4. A frame as set forth in claim 3, wherein said upper longitudinal beam has a wider web than that of said last-mentioned lugs so that the latter are nested within the former at their junctures.

5. A knockdown frame for supporting merchandise display and housing equipment, comprising (a) a pair of laterally spaced transverse beams of channel cross-section on the same level adjacent the lower end of the frame, with the flanges of said channels extending downwardly, (b) a vertical strut of channel form affixed to the downwardly facing flanges of each of said beams with the flanges of the channel of said strut extending outwardly, (c) a second pair of laterally spaced transverse beams of channel cross-section on the same level at the upper end of the frame and overlying said first pair of transverse beams, the flanges of the second pair of channels extending downwardly, (d) means for joining the upper end of said vertical strut to the downwardly facing flanges of said second pair of beams, (e) channeled lugs affixed to the lower end of each strut and to the flange of the beam adjacent thereto, (f) a longitudinal beam of channel cross-section with downwardly extending flanges connected between said first-mentioned spaced beams and having the opposite ends thereof supported by and affixed to said lugs, and (g) a second longitudinal beam overlying said first-mentioned longitudinal beam and connected between said second pair of transverse beams and the upper ends of said vertical struts.

* * * * *